United States Patent [19]

Buske

[11] Patent Number: 4,628,723

[45] Date of Patent: Dec. 16, 1986

[54] CLAMP SUPPORT

[76] Inventor: Ervin Buske, 1005 Market St., Gowrie, Iowa 50543

[21] Appl. No.: 751,206

[22] Filed: Jul. 2, 1985

[51] Int. Cl.[4] ..... B21D 1/12

[52] U.S. Cl. ..... 72/422; 72/705

[58] Field of Search ..... 72/705, 422; 269/9, 269/88; 248/507

[56] References Cited

U.S. PATENT DOCUMENTS

| | | | |
|---|---|---|---|
| 4,337,636 | 7/1982 | Clausen | 72/457 |
| 4,400,969 | 8/1983 | Specktor | 72/457 |
| 4,404,838 | 9/1983 | Hare | 72/457 |
| 4,463,937 | 8/1984 | Celette | 269/17 |
| 4,490,918 | 1/1985 | Clausen | 33/180 AT |
| 4,542,636 | 9/1985 | Wright | 72/705 |

FOREIGN PATENT DOCUMENTS

| | | | |
|---|---|---|---|
| 570518 | 7/1945 | United Kingdom | 269/9 |

*Primary Examiner*—Lowell A. Larson

*Attorney, Agent, or Firm*—Nies, Webner, Kurz & Bergert

[57] ABSTRACT

A clamp support for securing an automobile body part to a ramp has a base secured to a ramp, an upwardly open socket on its base, and an upstanding post with oppositely extending arms, one higher than the other, upon either of which a clamp may be mounted. The post is insertable in the socket so as to dispose either arm beneath a vehicle supported on the ramp.

3 Claims, 5 Drawing Figures

FIG. 1
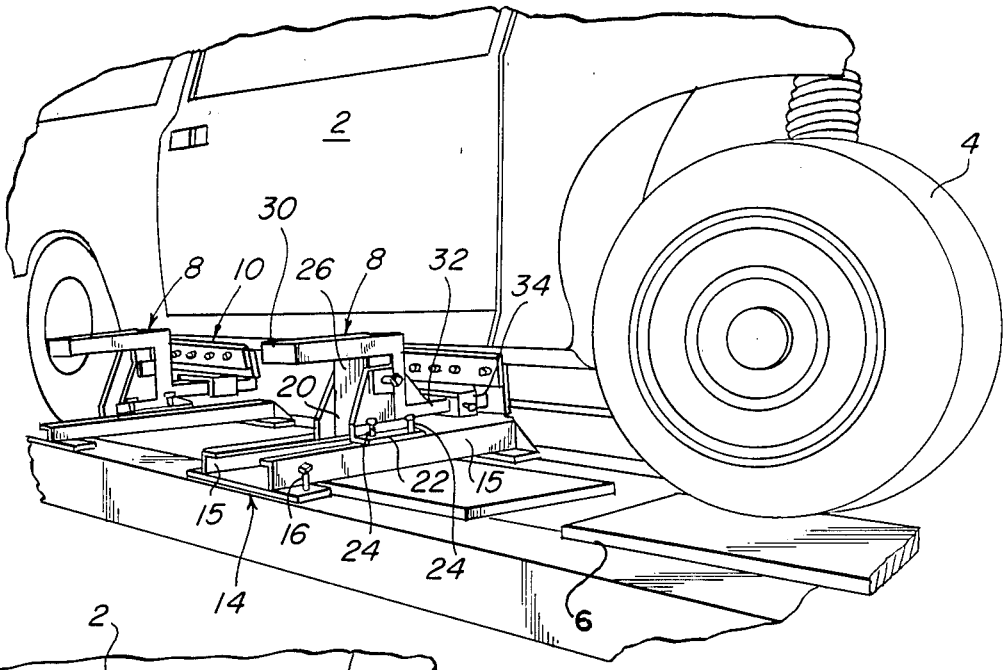
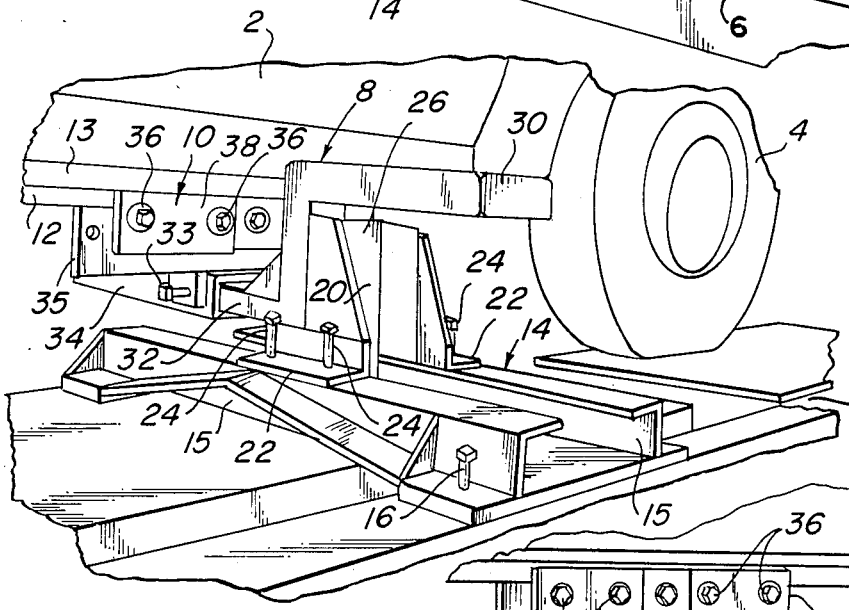
FIG. 2
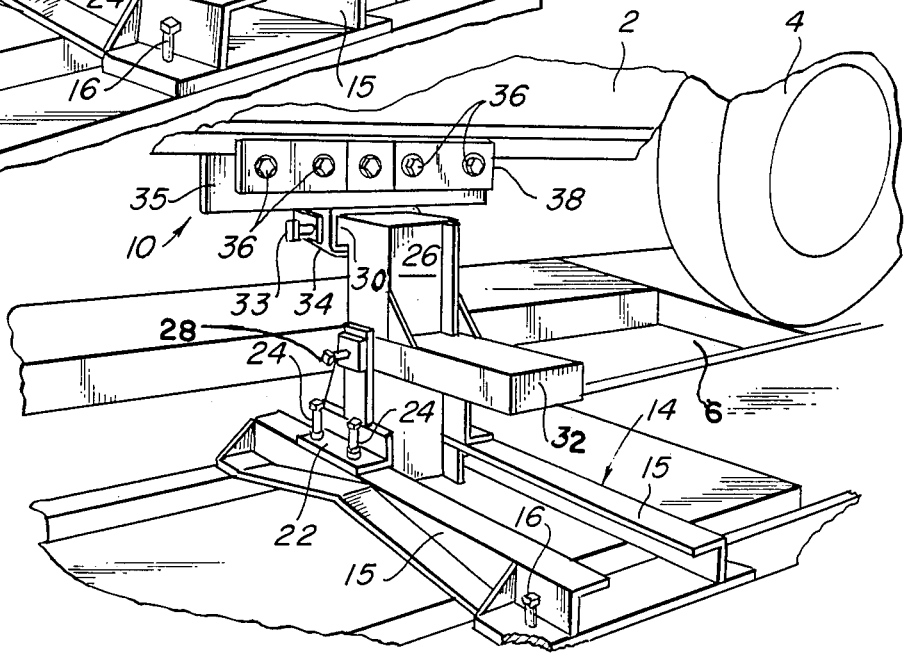
FIG. 3

CLAMP SUPPORT

FIELD OF INVENTION

Vehicle Body or Frame Straightener in class 72, subclass 705.

BACKGROUND OF THE INvENTION

Prior to so-called "frameless" automobiles, there were a number of locations on a vehicle frame that could be engaged for holding part of the frame stationary while a pulling or pushing force was applied to another part of the frame or to the body which was attached to the frame. However, with the advent of "frameless" vehicles, a new mechanism for engaging the vehicle body had to be devised, and this was a clamp which engages a weld seam which usually runs along the lower inner side of the vehicle rocker panel. Normally, such a clamp was secured either to a hold-down on the body shop floor or to a platform upon which the vehicle rested. When using such a clamp, great care must be exercised to distribute the stresses on the undercarriage so as to prevent ripping and twisting of the rocker panels. Another problem had to do with the fact that in some instances the automobile was not raised from the platform, and in others it was jacked up so as to permit access to the underbody and for clearance of measuring systems. Hence, a clamp support capable of being variable in height, depending upon the height of the vehicle with respect to the supporting ramp had to be devised.

OBJECTS

The pmary object of this invention is to provide a clamp support having a dual setting, a low one for fast hook-ups to the rocker panels without raising the car, and a high one for providing clearance for measuring systems in underbody access while, in either case, holding the automobile body firmly clamped to rack ramp.

In furtherance of the foregoing, it is intended now to provide a base for mounting on to a platform ramp, a socket on the base, a post engageable in the socket, oppositely extending arms, one high and one low, on the post, and a clamp mounting engageable on the free end of either of the arms. With this arrangement, either the high arm or the low arm may be used, depending upon whether the vehicle is to be rested at a low level on the ramp or whether it is to be jacked up at a higher level.

These and other objects will be apparent in the following specification and drawings in which:

FIG. 1 is a perspective view showing part of a vehicle on a platform ramp with two clamp supports in place:

FIG. 2 is a perspective view of a fragment of the vehicle resting on a ramp with a clamp mounted on the low arm of the clamp support;

FIG. 3 is a view similar to FIG. 2 but showing a part of the vehicle in jacked-up position and a clamp mounted on the high arm of the clamp support;

Figure 4:
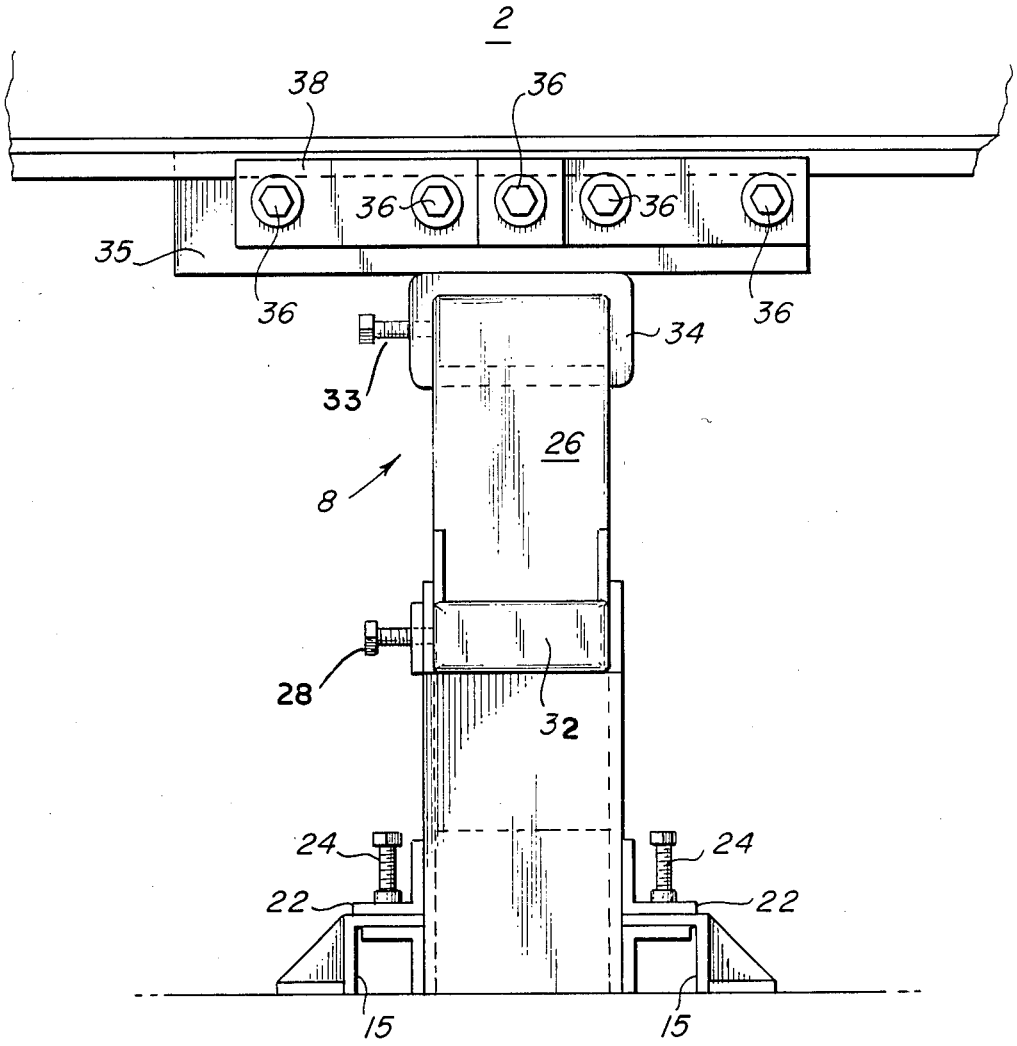
Figure 5:
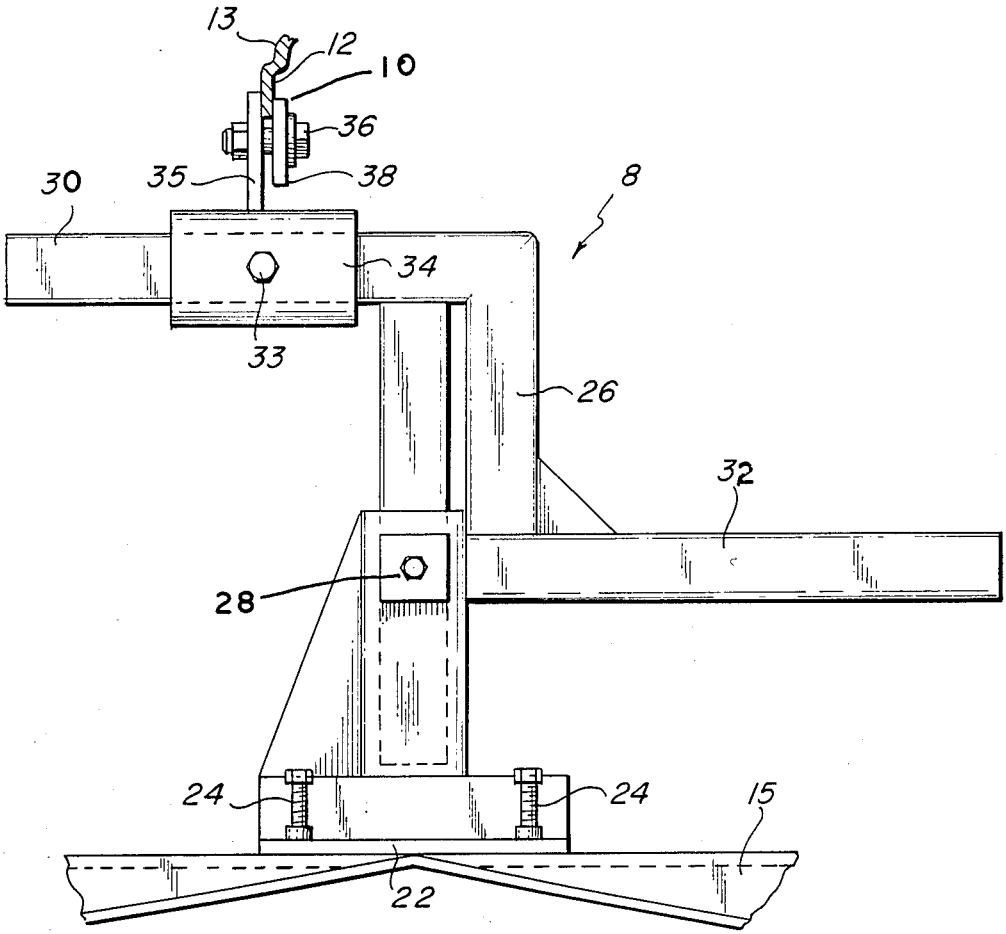

FIG. 4 is an end elevation showing the high arm of the clamp support in use; and, FIG. 5 is a side elevation of the clamp support in its FIG. 4 condition Referring now to the drawings which like reference numerals denote similar elements, the automobile body 2 is shown with a wheel 4 resting upon a ramp 6 of a platform, in a "quick hook up" condition wherein the body is to be connected to the ramp by means of clamps on clamp support 8. Clamps 10 are engaged onto a weld seam 12 (FIG. 2) running along the inner edge of the vehicle rocker panel 13.

This invention is concerned with the clamp support 8. It consists of a base 14 secured by bolts 16 to the ramp. The base consists of two girders 15 which extend crosswise of the ramp. An upwardly open socket 20 with outwardly extending flanges 22 is secured by bolts 24 to the base girders and a post 26 engages in socket 20 and is secured therein by bolts 28 so that the post cannot lift out of the socket. Extending outwardly from the upper end of post 26 is an upper arm 30 and a lower arm 32 extends oppositely from a lower portion of post 26. Engaging around either the upper or lower arm of post 26 is a sleeve 34 which is held in selected position on the arm by a set-screw 33. Clamps 10 each having one jaw 35 rigid with a sleeve 34 are secured by bolts 36 and bolted with jaws 35, 38 embracing the weld seam.

As is best shown in FIG. 4 and 5, either the upper arm 30 or the lower arm 32 of the clamp support may be used by loosening bolt 28 and lifting post 26 out of the socket 20, turning the post 26 so as to dispose the selected one of the arms inwardly towards the undercarriage of the vehicle, reinserting post 26 and retightening bolt 28. By utilizing a plurality of clamps as exemplified in FIG. 1, stresses on the vehicle body can be distributed so as to reduce the risk of tearing or twisting of the rocker panel.

I claim:

1. A clamp support for securing a portion of a vehicle body onto a ramp comprising, a base, means for attaching the base onto a ramp, an upwardly-open socket on said base, a post removeably engaging in said socket and normally extending upwardly therefrom, means for releaseably fastening the post in the socket, a first arm extending outwardly from one side of said post, a second arm extending oppositely outward from an opposite side of said post, said post being reversible in said socket whereby to dispose either of said arms towards said portion of said vehicle body, a sleeve slideably engaging over either of said arms, and a clamp on said sleeve, one of said arms being disposed at a relatively high level so that said clamp may be engaged onto the vehicle when the latter is jacked up from the ramp and the other arm being at a relatively low level so that the clamp may be engaged onto the vehicle when the latter is not jacked up from the ramp.

2. A clamp support as claimed in claim 1, said base comprising a pair of girders adapted to extend crosswise of the ramp, said socket having outwardly extending flanges secured onto said girders.

3. A clamp support as claimed in claim 1, said sleeve being slideable lengthwise of said arms whereby the sleeve may be engaged onto the weld seam of a vehicle rocker panel so as to apply a straight pull in either a downwardly or a longitudinal direction of the rocker panel when the clamp is engaged over the vehicle rocker panel weld seam.

* * * * *